US006449374B1

(12) United States Patent
Skulley et al.

(10) Patent No.: US 6,449,374 B1
(45) Date of Patent: Sep. 10, 2002

(54) CONFORMABLE EARHOOK FOR AN OVER-THE-EAR HEADSET

(75) Inventors: Gerald W. Skulley, Santa Cruz, CA (US); Thomas G. Skulley, St. Paul, MN (US)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 09/274,434

(22) Filed: Mar. 22, 1999

(51) Int. Cl.[7] ..... H04R 25/00
(52) U.S. Cl. ..... 381/381; 381/330
(58) Field of Search ..... 381/370, 381, 381/374, 375, 379, 385, 330, 376, 327; 379/430; 181/129; 2/209

(56) References Cited

U.S. PATENT DOCUMENTS

| | | | | | |
|---|---|---|---|---|---|
| 1,587,643 | A | * | 6/1926 | Harman | 181/135 |
| D242,724 | S | | 12/1976 | Brodie | D26/14 H |
| 5,210,792 | A | | 5/1993 | Kajihara | 379/430 |
| 5,412,736 | A | | 5/1995 | Keliiliki | 381/187 |
| 5,450,496 | A | | 9/1995 | Burris et al. | 381/183 |
| D375,313 | S | | 11/1996 | Jensen et al. | D14/206 |
| 5,625,171 | A | | 4/1997 | Marshall | 181/130 |
| 5,757,944 | A | | 5/1998 | Jensen et al. | 381/187 |
| 5,761,298 | A | * | 6/1998 | Davis et al. | 379/430 |
| D403,327 | S | | 12/1998 | Landreth et al. | D14/223 |
| 5,881,161 | A | * | 3/1999 | Liu | 381/381 |
| 6,035,961 | A | * | 3/2000 | Sun | 181/129 |
| 6,104,824 | A | * | 8/2000 | Ito | 381/381 |
| D436,095 | S | * | 1/2001 | Schmidt et al. | D14/206 |

OTHER PUBLICATIONS

"Human Factors Research For On–the–Ear Wearing Styles and Convertibility in Telephone Headset Design: A Development Case Study for the GN Netcom Profile SureFit Headset", 1998, GN Netcom, Inc., Nashua, NH, U.S.A., pp. 1–5.
Brochure for Profile SureFit, GN Netcom, Inc., Apr. 1999.
Picture of JVC HA–B10–BU headphone.
Picture of Phillips SBC HS700 headphone.

* cited by examiner

*Primary Examiner*—Curtis Kuntz
*Assistant Examiner*—P. Dabney
(74) *Attorney, Agent, or Firm*—Peter Hsien

(57) ABSTRACT

An earhook for a communications headset includes a prehensile portion adapted to curve at least partially around and behind an ear in substantially a first plane, the prehensile portion resiliently biased toward the ear in the first plane to provide clamping pressure against the ear; a compressible portion coupled to the prehensile portion and disposed between the prehensile portion and the ear, the compressible portion adapted to curve at least partially around and behind the ear in substantially the first plane to conform to the ear in response to the clamping pressure and the shape of the ear; and a digit receiving member coupled near a first end of the prehensile portion, the digit receiving member for removeably receiving a digit for opening the prehensile portion by exerting force upon the first end directed away from a second end of the prehensile portion.

45 Claims, 15 Drawing Sheets

CONFORMABLE EARHOOK FOR AN OVER-THE-EAR HEADSET

BACKGROUND OF THE INVENTION

1. Field of the Invention

The present invention relates generally to headsets for use in telecommunications and telephony, and more particularly, to a conformable earhook for an over-the-ear style headset.

2. Description of the Background Art

Communication headsets can be used in a diversity of applications and are particularly effective for telephone operators, radio operators, aircraft personnel, and for other individuals to whom it is desirable to have "hands free" operation of communication systems. Accordingly, a wide variety of headsets are known in the prior art.

Monaural headsets are headsets which have only a single audio receiver situated near one ear. Often, such headsets are implemented with an "earhook" that fits around the ear to secures the receiver in place. Such headsets may be quite compact, and are often preferred to biaural headsets that use various forms of headbands to secure the receiver.

Unfortunately, because of the large natural variation in the size, shape, and orientation of human ears, over-the-ear style headsets often do not fit properly. In particular, earhooks are often not stable, i.e. do not fit snugly, and are not comfortable across a large spectrum of potential users.

The ergonomic goals of stability and comfort are often in conflict, however, since a snug fit that provides a secure attachment for the headset often precludes the ability to easily don the headset with only one hand. Likewise, a snug fit often pinches the ear or creates pressure points that are uncomfortable for many users.

Some previously known earhook solutions have used hard, extendible pieces to lengthen the earhook behind the ear lobe. Others have used small, pivotable flippers to close the gap behind the ear. However, these earhooks typically have fixed contours with either no or limited predetermined ranges of motion and shape that only fit a fraction of the population of users. Consequently, they are not comfortable for many users and do not provide a secure fit.

Other known earhook solutions employ molded, rubber-like material, either alone or reinforced with metal wire inserts. Unfortunately, the rubber earhooks often stretch, allowing the earhook to slide or rotate about the ear. Moreover, wire reinforced designs often fatigue and break with continuous use, reducing the useful life of the headset. In addition, such earhooks generally require two-hand fitting by the user and must be squeezed tightly and bent into shape in order to provide any level of clamping force. Removing the installed earhook usually distorts its previous wearing shape and requires the user to reshape the earhook each time that it is worn.

Accordingly, what is needed is an earhook that provides a snug, secure fit for a wide variety of ear shapes, sizes, and orientations. Moreover, what is needed is an earhook that is comfortable to be worn for extended periods of time. What is also needed is an earhook that can be easily grasped, opened, and positioned on an ear with only one hand.

SUMMARY OF THE INVENTION

The present invention overcomes the limitations of conventional headset designs with a earhook that fits both snugly and comfortably, conforming to individual ear contours, and may be easily grasped, opened, and positioned on the ear with only one hand.

In one aspect of the invention, the earhook includes a prehensile portion having a curved portion that curves at least partially around and behind an ear to securely grasp the ear. The earhook also includes a first digit receiving member, such as a loop, coupled near a first end of the prehensile portion. The first digit receiving member removeably receives one of the user's digits, and advantageously allows the user to open the prehensile portion with only one hand by exerting force upon the first digit receiving member directed away from a second end of the prehensile portion. The user then easily places the earhook on the ear, adjusts it into position, and releases it.

The earhook may additionally include a second digit receiving member coupled near the second end of the prehensile portion. The second digit receiving member, in combination with the first, allows the user to conveniently open the prehensile portion with only one hand by exerting oppositely-directed forces on the first and second digit receiving members.

In one embodiment, at least one digit receiving member is made of a compressible material, such that the digit receiving member is deformable when placed against a the back or bottom of the ear. This feature allows a digit receiving member to have a relatively large diameter to fit a variety of finger or thumb sizes, but to also have a reduced diameter when the digit receiving member is worn.

In another aspect of the invention, the prehensile portion is resiliently biased toward the ear to provide clamping pressure against the ear. The prehensile portion includes at least one substantially rigid portion and one or more flexible portions. The flexible portions may have a reduced cross-sectional area relative to the cross-sectional area of the rigid portion. In addition, one flexible portion may have a different degree of flexibility than the other flexible portion, allowing the first and second flexible portions, in combination, to provide progressive clamping pressure against the ear. One flexible portion may be located at about the apex of the ear, whereas the other flexible portion may be located at about the opposite side of the ear, near the bottom of the ear.

In another aspect of the invention, the earhook includes a compressible portion, coupled to the prehensile portion and disposed between the prehensile portion and the ear. The compressible portion conforms to the shape of the ear in response to the clamping pressure exerted by the prehensile portion, providing a high degree of comfort as well as a snug fit for a variety of ear sizes and shapes. In one embodiment, the compressible portion has a greater radial thickness than the prehensile member to permit the compressible member to conform to a wide variety of ear shapes and sizes.

In yet another aspect of the invention, the earhook is coupled with an audio receiver in a communication headset. The prehensile portion of the earhook may flex within a second plane substantially perpendicular to the plane of the earhook, creating a normal force directed toward the plane of the earhook to hold the audio receiver securely in place over the ear.

In still another aspect the present invention, a method is provided for donning a communication headset comprising a resiliently-biased earhook and a digit receiving member disposed at a first end of the earhook. The method includes the steps of grasping a second end of the earhook with two digits, inserting a digit into the digit receiving member, exerting a force on the digit receiving member directed away from the second end, positioning the earhook on the ear; and removing the digit from the digit receiving member to allow the earhook to resiliently grasp the ear. In one embodiment, the earhook includes first and second flex points, and the positioning step includes positioning the second flex point at about the apex of the ear, and the first flex point at about an opposite side of the ear.

The foregoing features advantageously provide a conformable earhook for an over-the-ear style headset that fits both snugly and comfortably on the ear. The prehensile portion provides gentle, progressive clamping pressure against the ear, while the compressible portion conforms to the ear in response to the clamping pressure as dictated by individual ear contours, allowing the earhook to fit a wide variety of ear sizes and shapes. The digit receiving member, in combination with the resilient bias of the prehensile member, allows the earhook to be easily grasped, opened, and positioned on the ear with only one hand, unlike conventional earhooks.

BRIEF DESCRIPTION OF THE DRAWINGS

These and other more detailed and specific objects and features of the present invention are more fully disclosed in the following specification, reference being had to the accompanying drawings, in which.

DETAILED DESCRIPTION OF THE PREFERRED EMBODIMENTS

Figure 1B:
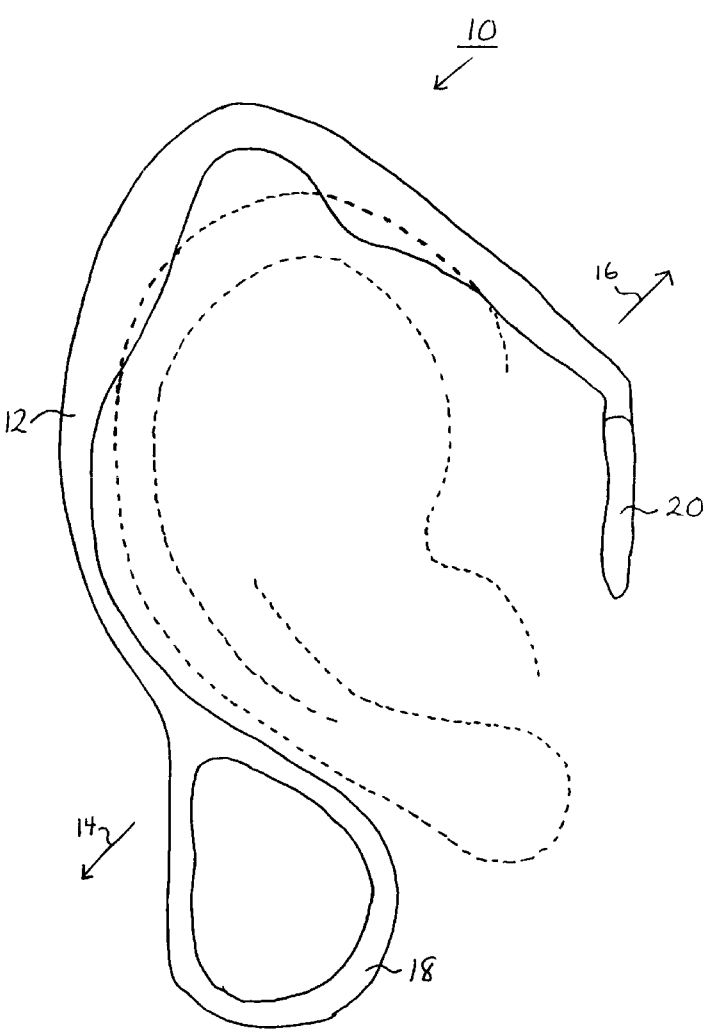
FIG. 1B is a plan view of an earhook according to an embodiment of the present invention.
Figure 1A:
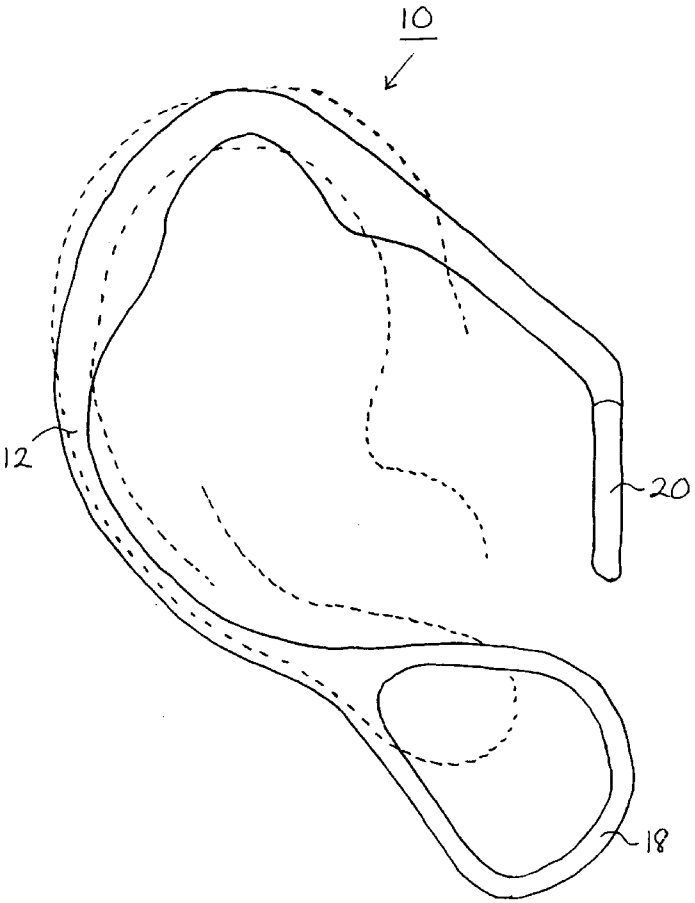
FIG. 1A is a plan view of an earhook according to an embodiment of the present invention.

Referring now to FIG. 1A, there is illustrated an earhook 10 in a substantially closed or static configuration. In one embodiment, the earhook 10 includes a prehensile member 12 adapted to curve at least partially around and behind the ear in a plane substantially vertical to the plane of the ear. As shown in FIG. 1A, the prehensile member 12 may have an arcuate or crescent shape to conveniently wrap around and securely grasp the ear, although other configurations are possible. For example, the inner, skin-contacting surface of the prehensile member 12 may have an arcuate shape, whereas the outer surface may be substantially rectilinear.

In one embodiment, the prehensile member 12 is formed using any of a number of commercially available, high performance thermoplastics, such as ABS, propylene, Hytrel, Delrin, or nylon, all of which are well known to those skilled in the art. It should be recognized, however, that many different materials with similar properties could be used within the scope of the present invention. The prehensile member 12 gives the earhook 10 rigidity for exerting clamping pressure against the ear, as described in greater detail below.

In one embodiment, the prehensile member 12 may additionally include an outer covering or surface comprising a soft and compressible elastomer, such as Santoprene, Kraton, silicone, or Hytrel, each of which are widely available in the art. It should be recognized, however, that many different materials with similar properties could be used within the scope of the present invention. The outer covering gives the prehensile member 12 contact surface comfort and allows the prehensile member 12 to conform to the shape of the ear.

Although relatively rigid, the prehensile member 12 is flexible within the plane of the earhook 10 and is resiliently biased in the direction of the ear to provide clamping pressure. In other words, the prehensile member 12 may be stretched open in opposition to the clamping pressure, but it will naturally return to its closed, unstretched state when an opening force is removed. For example, FIG. 1B illustrates the earhook 10 in an stretched or opened state. Opposing forces, shown by arrows 14 and 16, may be applied to the ends of the prehensile member 12 to stretch open the prehensile member 12 to a diameter relatively larger than the diameter of the ear. However, when the forces are removed, the resilient bias of the prehensile member 12 causes the earhook to 10 return to its closed state, as shown in FIG. 1A, to securely gasp the ear.

Figure 1C:
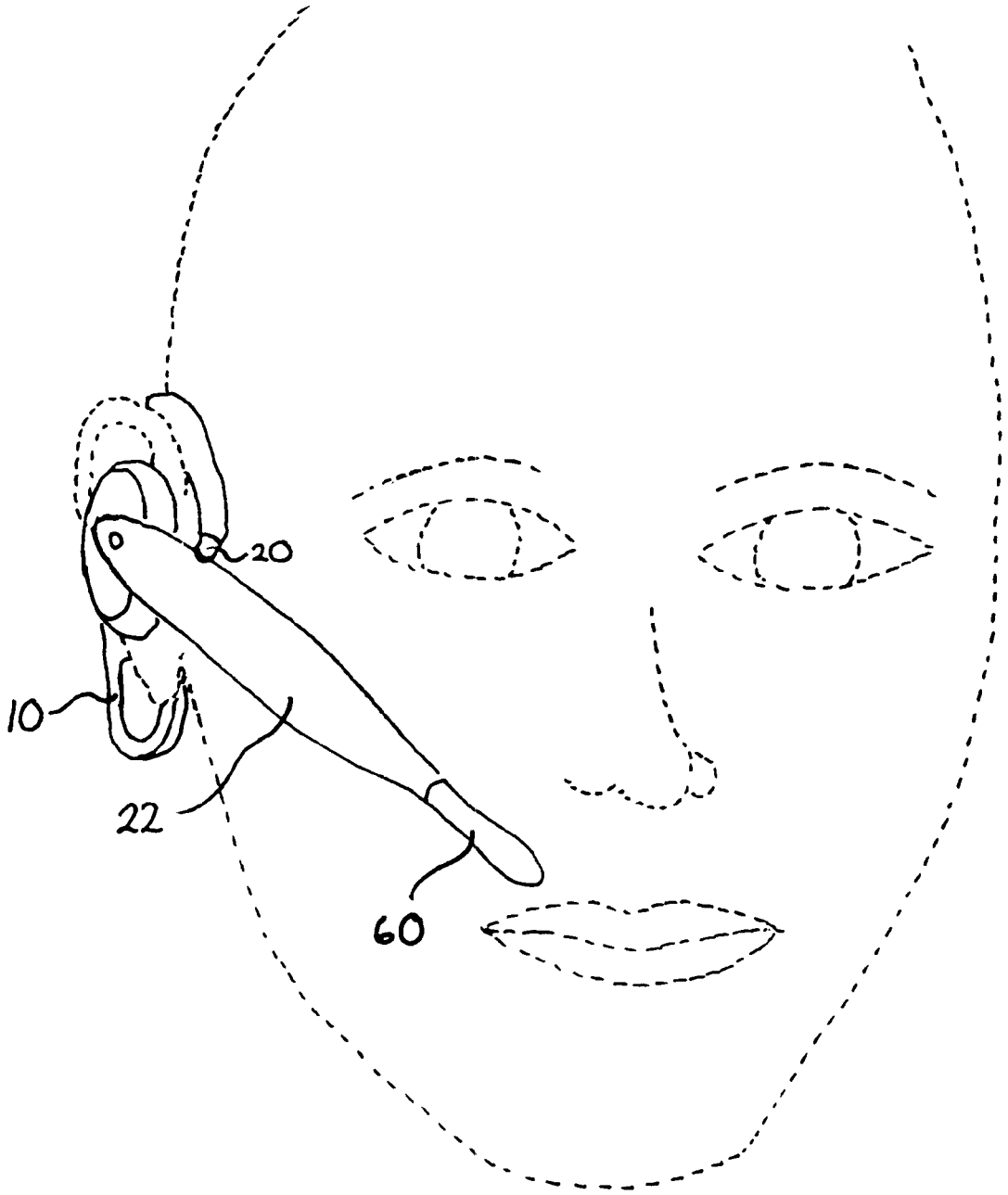
FIG. 1C is a perspective view of an earhook as worn on the ear according to an embodiment of the present invention.

In one embodiment, a first end of the prehensile member 12 is coupled to a digit receiving member 18, such as a closed (see FIGS. 1A–E and 2–4) or partially-closed loop (see FIGS. 1F and 1G), for removeably receiving a thumb or finger of the user. The digit receiving member 18 may be formed as a separate component or as an integral part of the prehensile member 12. For example, as illustrated in FIG. 1A, the digit receiving member 18 is integral with the prehensile member 12. The digit receiving member 18 should have a sufficient diameter to removeably receive a thumb or finger of the user, and is used for opening the earhook 10, as described more fully below.

Figure 1D:
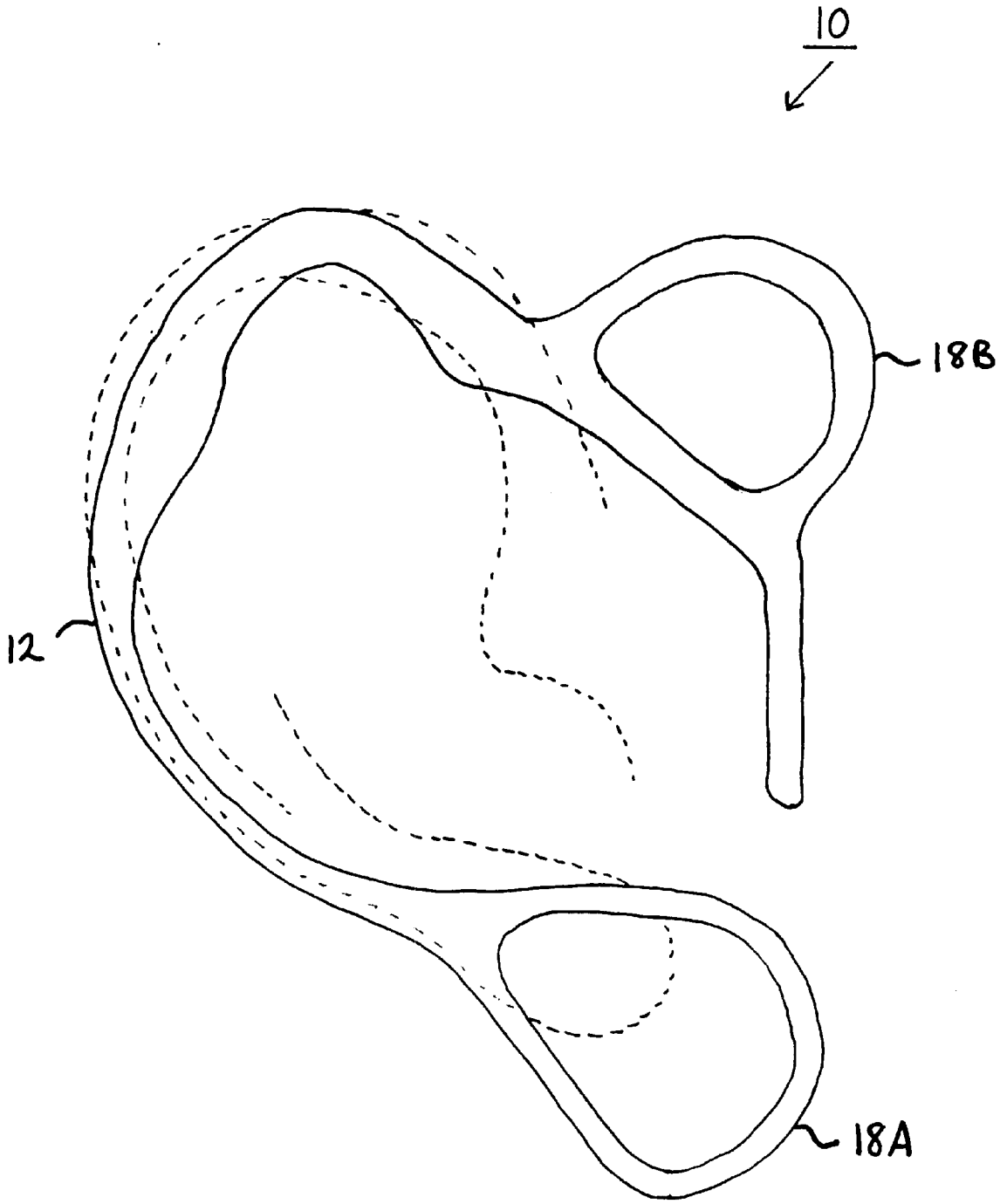
FIG. 1D is plan view of an earhook according to an embodiment of the present invention.

Referring now to FIG. 1D, there is shown an alternative embodiment of the earhook 10, which includes first and second digit receiving members 18A–B. As described more fully hereafter, the first and second digit receiving members 18A–B may be advantageously used to don the earhook 10 with only one hand. For example, a user may insert a thumb into member 18A and an index finger into member 18B and exert opposing forces on the members 18A–B to open the earhook 10.

Referring again to FIG. 1A, a second end of the prehensile member 12 is coupled to a spindle 20 or other joining mechanism for coupling the prehensile member to an audio receiver/transmitter assembly 22, as shown in FIG. 1C. For example, the spindle 20 may be inserted into a reciprocal recess (not shown) on the audio receiver/transmitter assembly 22 to form a joint, as described hereafter. The spindle 20 may be a either a separate component or an integral part of the prehensile member 12.

Figure 1E:
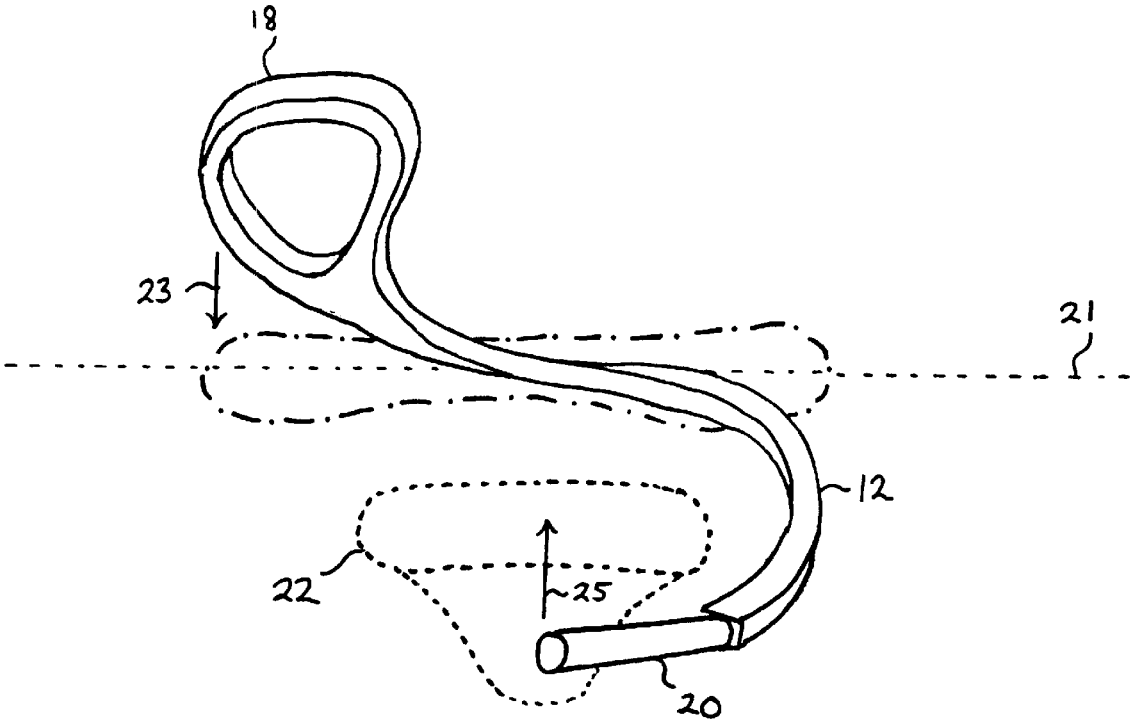
FIG. 1E is a side view of an earhook from below the ear according to an embodiment of the present invention.
Figure 1G:
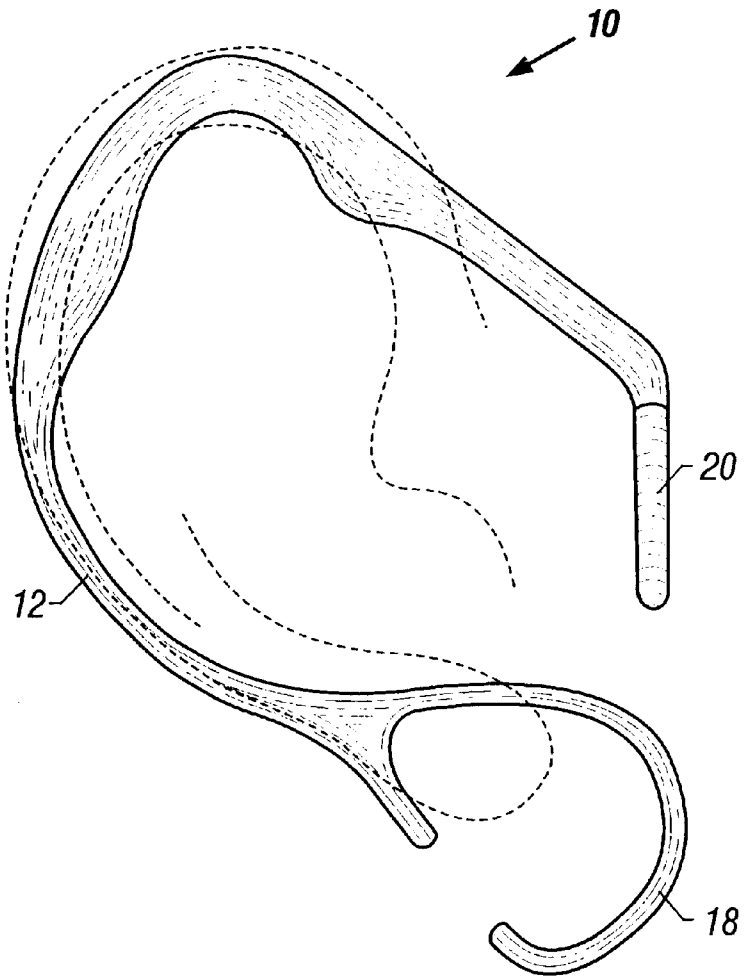
FIG. 1G is a plan view of an earhook according to an alternative embodiment of the present invention.
Figure 1F:
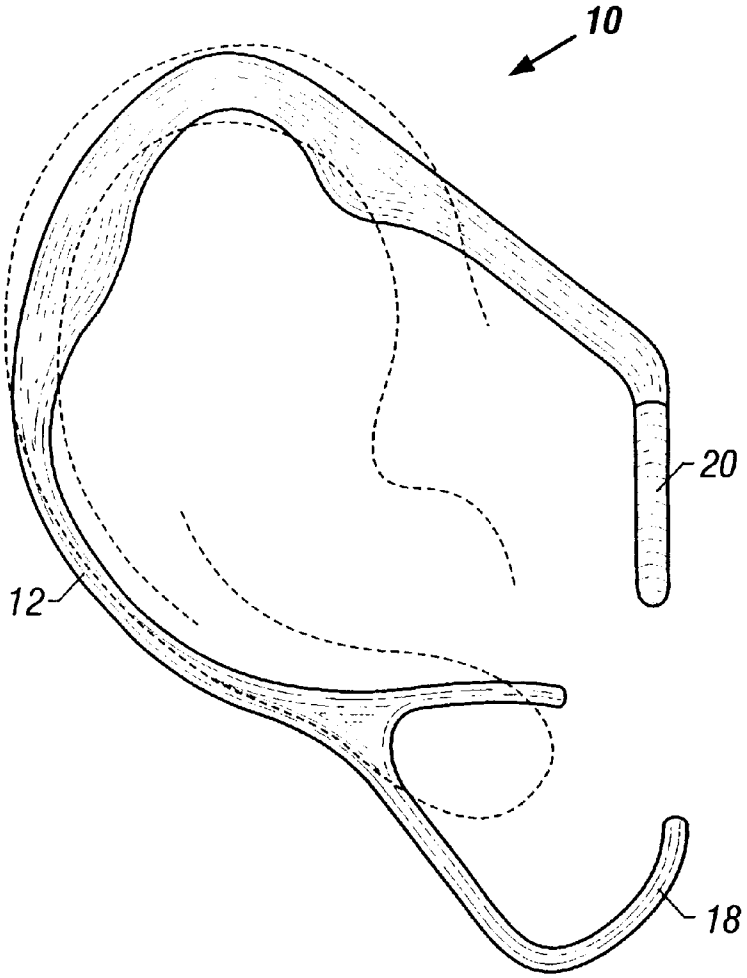
FIG. 1F is a plan view of an earhook according to an alternative embodiment of the present invention.

Referring now to FIG. 1E, there is shown a side view of the earhook 10 from a point below the ear while the earhook 10 is being worn. In one embodiment, the prehensile member 12 can flex or twist orthogonally to the regular plane of the earhook 10 (shown by dashed line 21) in response to torsion, and the prehensile member 12 is resiliently biased to return to plane 21 when the torsion is removed. This ability to flex out-of-plane provides a number of benefits. For example, it allows the prehensile member 12 to conform to a multi-plane contour of the head around the ear. Typically, the contour of the head around the ear is not confined to a single plane. Thus, the ability to flex out-of-plane allow the earhook to be worn comfortably and securely by a greater number of users.

Additionally, the resilient bias in the direction of plane 21 generates normal forces (indicated by arrows 23 and 25) in the direction of plane 21 on each end of the prehensile member 12. The normal force 25 on the spindle 20 end of the prehensile member 12 is used in one embodiment to securely hold the audio receiver/transmitter assembly 22 against the ear.

Figure 2A:
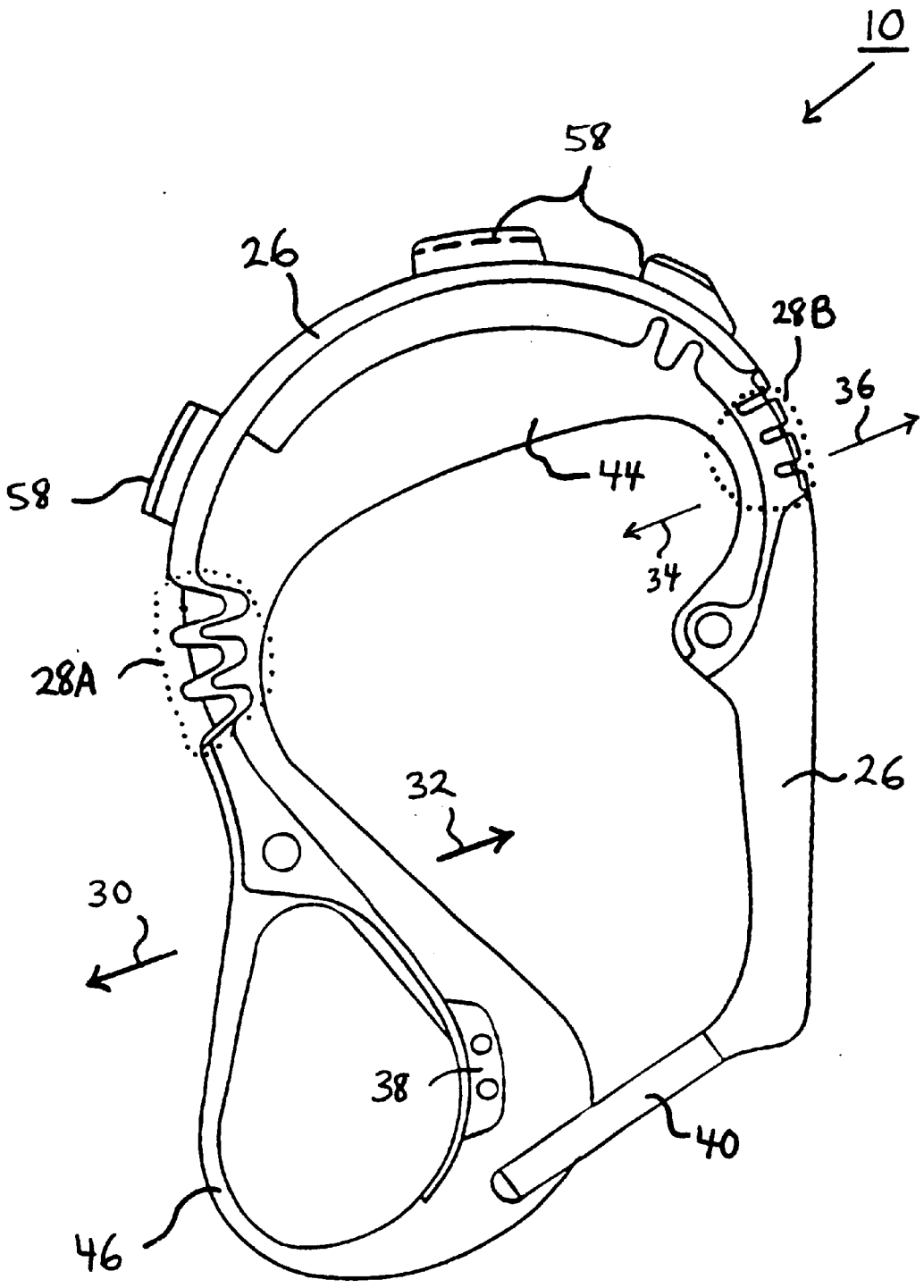
FIG. 2A is a plan view of an earhook according to an embodiment of the present invention.

Referring now to FIG. 2A, there is shown an alternative embodiment of the present invention wherein the earhook 10 comprises a two-part plastic assembly, either insert or "dual shot" molded, with plastic materials of two different chemistries or durameters. The two primary components of the earhook 10 are detailed below with respect to FIGS. 2B and 2C, respectively.

Figure 2C:
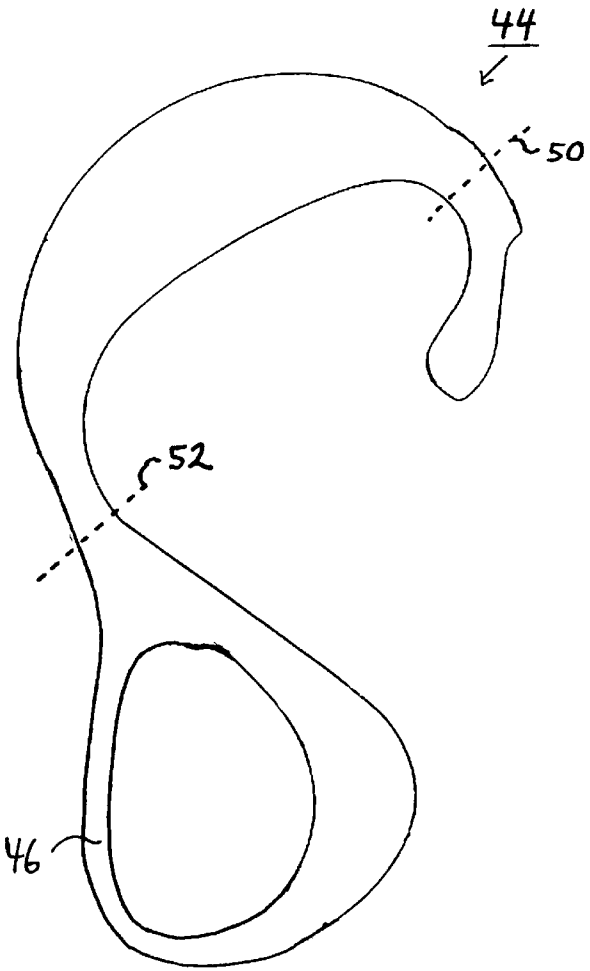
FIG. 2C is a plan view of a compressible member of an earhook according to an embodiment of the present invention.
Figure 2B:
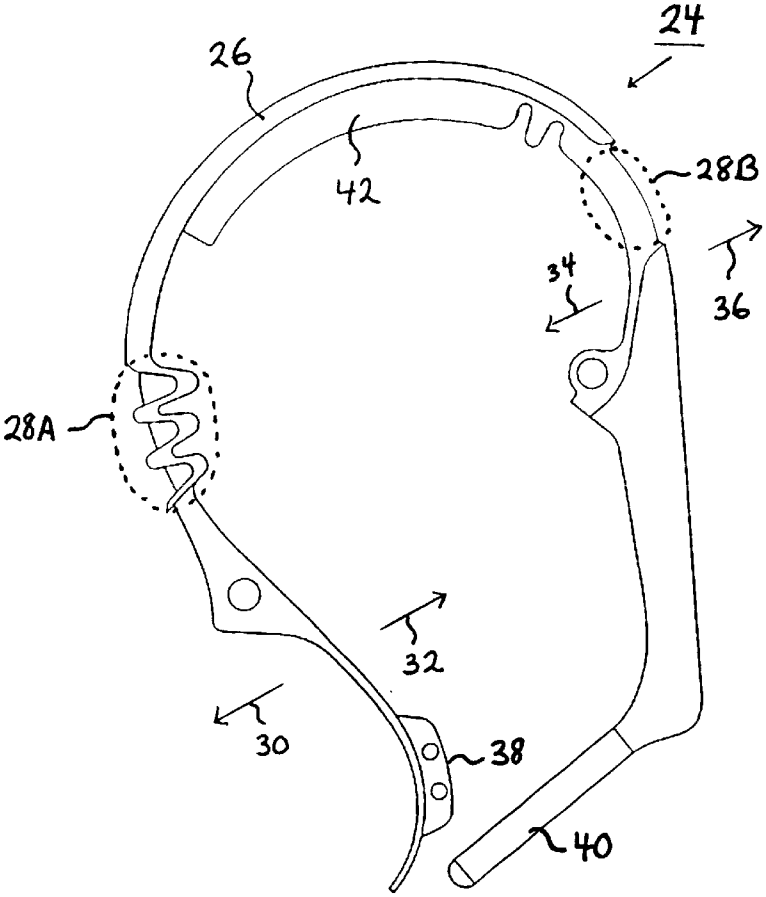
FIG. 2B is a plan view of a prehensile member of an earhook according to an embodiment of the present invention.

As shown in FIG. 2B, the earhook 10 includes an prehensile member 24 adapted to curve at least partially around and behind the ear in a plane substantially vertical to the plane of the ear. The prehensile member 24 has an arcuate or crescent shape to conveniently wrap around and securely grasp the ear, although other configurations are possible. In one embodiment, the prehensile member 24 comprises a high performance thermoplastic such as ABS, propylene, Hytrel, Delrin, or nylon, all of which are well known to those skilled in the art.

In one embodiment, the prehensile member 24 includes at least one substantially rigid portion 26, as well as one or more flexible portions 28A–B. The increased flexibility of the flexible portions 28A–B may be achieved, for example, by reducing the cross-sectional areas of the flexible portions 28A–B relative to the rigid portion 26. Alternatively, the flexible portions 28A–B may have different geometries than the rigid portion 26. For example, as shown in FIG. 2B, the flexible portion 28A may be corrugated to provide increased flexibility and greater wear resistance.

The flexible portions 28A–B allow the prehensile member 24 to flex longitudinally within the plane of the earhook 10 as indicated by the arrows 30–32 and 34–36, respectively. Additionally, the prehensile member 24 is resiliently biased in the direction of arrows 32 and 34 to provide constant clamping pressure against the ear.

In one embodiment, flexible portion 28A has a greater degree of flexibility than flexible portion 28B. The different degrees of flexibility allow the prehensile member 24 to provide "progressive" clamping pressure against the ear, which, in combination with the locations of the flexible portions 28A–B, reduces the occurrence "pinch" points and allows the earhook 10 to be worn by a wider number of users.

In one embodiment, the prehensile member 24 is configured such that the flexible portion 28B is located at about the apex of the ear when the earhook is worn, while the flexible portion 28A is located at a point on the ear substantially opposite the apex, referred to hereafter as the anti-apex. These locations have been demonstrated experimentally to provide desirable flexing and shape change of the prehensile member 24 to accommodate a greater number of ear shapes, sizes and orientations. However, other locations of the flexible portions 28A–B are possible without departing from the spirit of the invention. Moreover, a greater or lesser number of flexible portions 28 could be used within the scope of the invention.

Figure 2D:
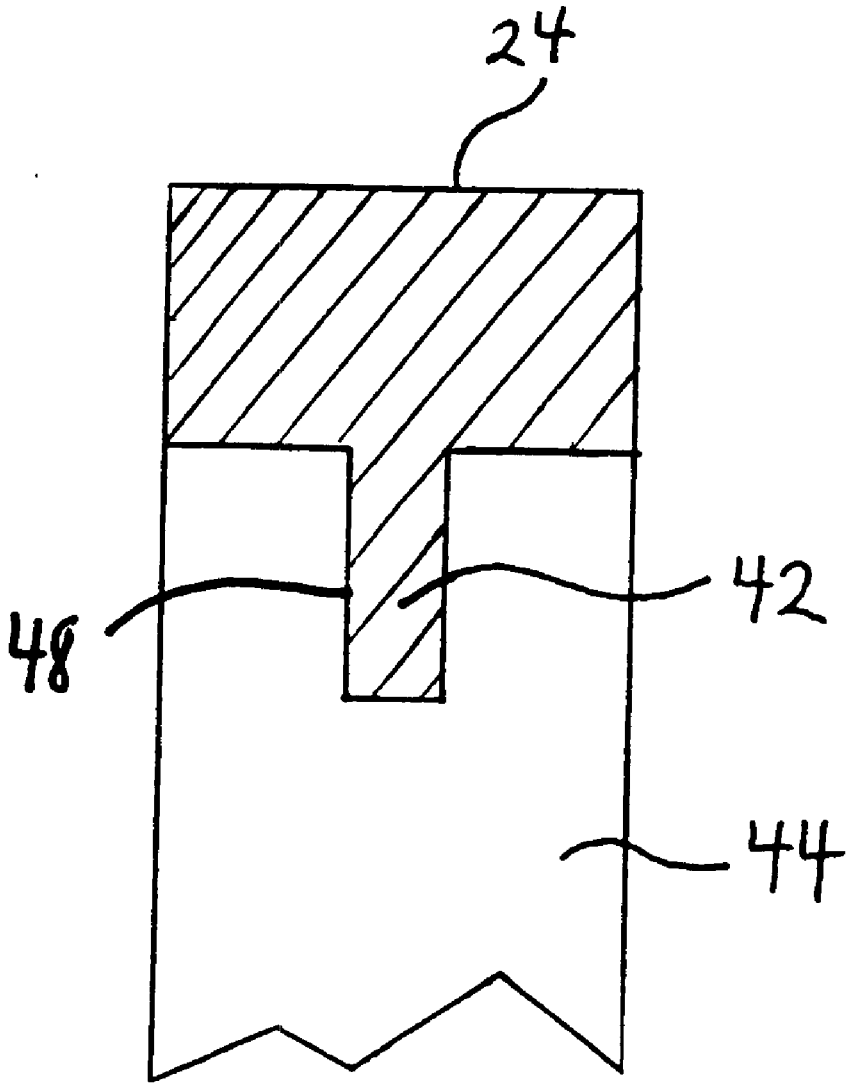
FIG. 2D is a sectional view of an earhook according to an embodiment of the present invention.
Figure 2E:
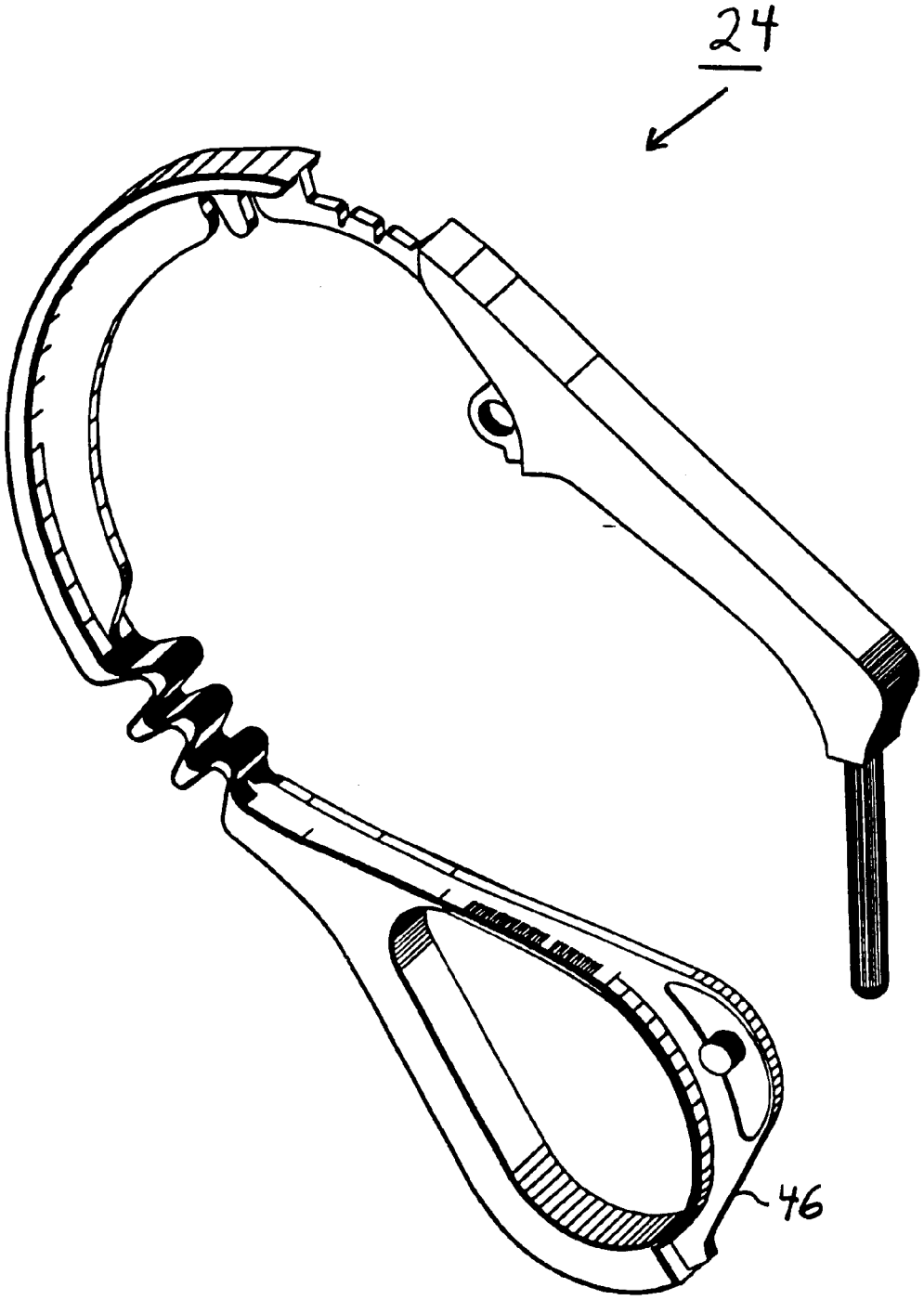
FIG. 2E is a perspective view of an earhook according to an embodiment of the present invention.

As illustrated in FIG. 2B, one end of the prehensile member 24 includes one or more mounting brackets 38 for coupling a digit receiving member 46 (not shown) to the prehensile member 24. As noted earlier, the digit receiving member 46 may be a loop having a sufficient diameter to removeably receive a thumb or finger of the user. In other embodiments, however, the prehensile member 24 may be integral with the digit receiving member 46, as shown in FIG. 2E, which is a perspective view of an alternative embodiment of the prehensile member 24.

Figure 3A:
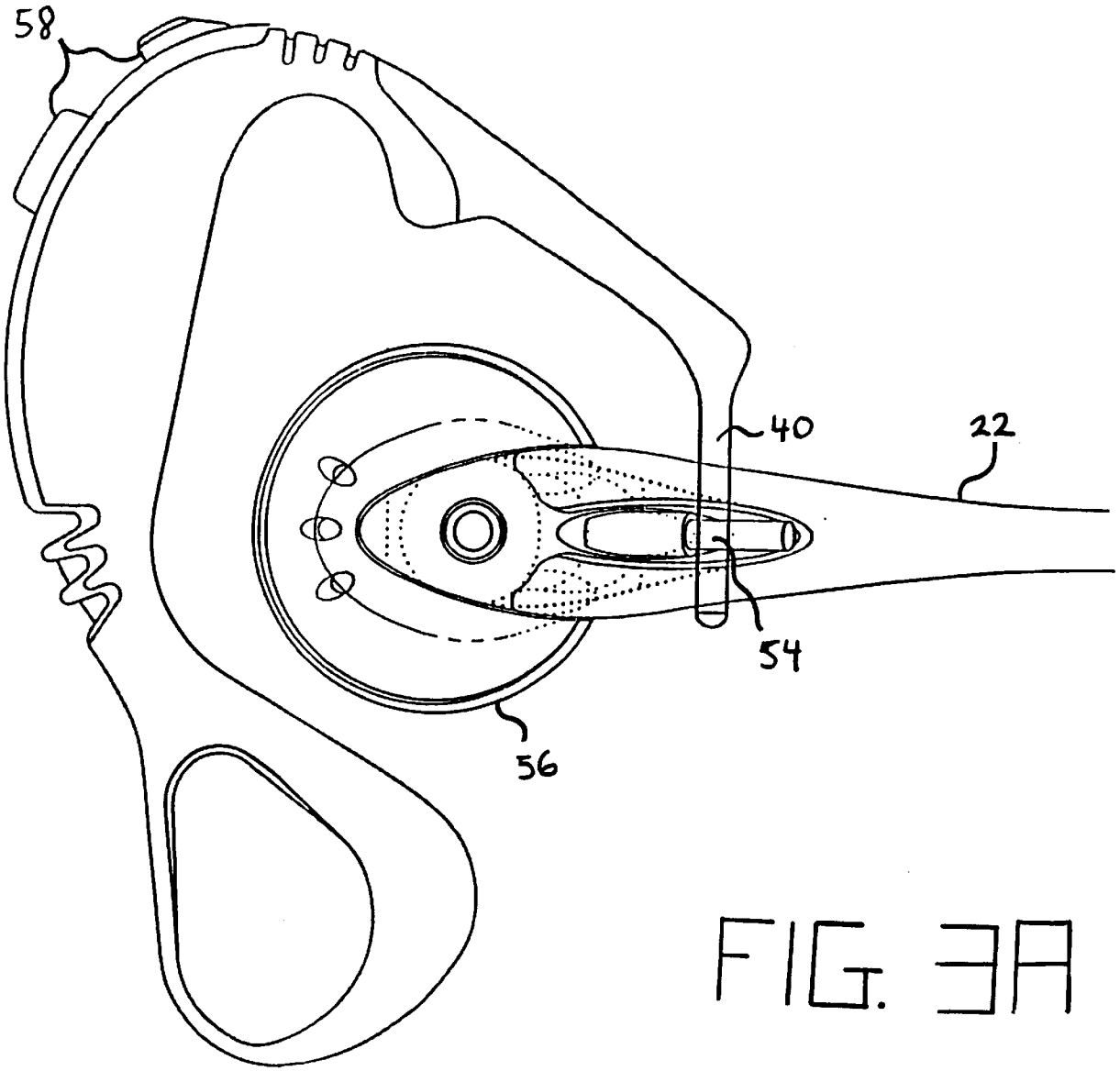
FIG. 3A is a plan view of an earhook and an audio receiver/transmitter assembly according to an embodiment of the present invention.

Referring again to FIG. 2B, coupled to the opposite end of prehensile member 24 is a spindle 40 or other similar joining mechanism for coupling the prehensile member 24 to an audio receiver/transmitter assembly 22, as illustrated in FIGS. 1C and 3A. In one embodiment, the audio receiver/transmitter assembly 22 includes a reciprocal opening for receiving the spindle to form a joint, which allows the user to selectively position of audio receiver/transmitter assembly 22 on one or more axes with respect to the prehensile member 24.

Longitudinally disposed on the inner surface of the prehensile member 24 are one or more elastomer capture members or vanes 42, which are used to secure the prehensile member 24 to a soft and compressible inner member 44, shown in FIG. 2C and described immediately hereafter. As illustrated in the cross-sectional view of FIG. 2D, a vane 42 is received by a reciprocal groove 48 in the compressible member 44 to securely hold the compressible member 44 in place with respect to the prehensile member 24.

Referring now to FIG. 2C, there is shown an illustration of the second major component of the earhook 10, which is the compressible member 44. In one embodiment, the compressible member 44 is made of a soft and compressible elastomer such as Santoprene, Kraton, silicone, or Hytrel. Those skilled in the art, however, will recognize that many different materials with similar properties could be used within the scope of the invention. The compressible member 44 provides contact surface comfort when placed against the user's skin. Additionally, the compressible member 44 provides compression and expansion to conform to the shape of the ear to securely grasp the ear in response to the clamping pressure exerted by the prehensile member 24.

In one embodiment, the compressible member 44 is molded in an arcuate or crescent shape dictated by the contours behind and over the ear. The portion of the compressible member 44 between the apex of the ear (indicated by dashed line 50) and the anti-apex (indicated by dashed line 52) may have a greater radial thickness than the prehensile member 24, providing additional compressible material to allow the compressible member 44 to conform to a wider variety of ear shapes and sizes. In one embodiment, the radial thickness of the compressible member 44 tapers near the apex and anti-apex.

Figure 2F:
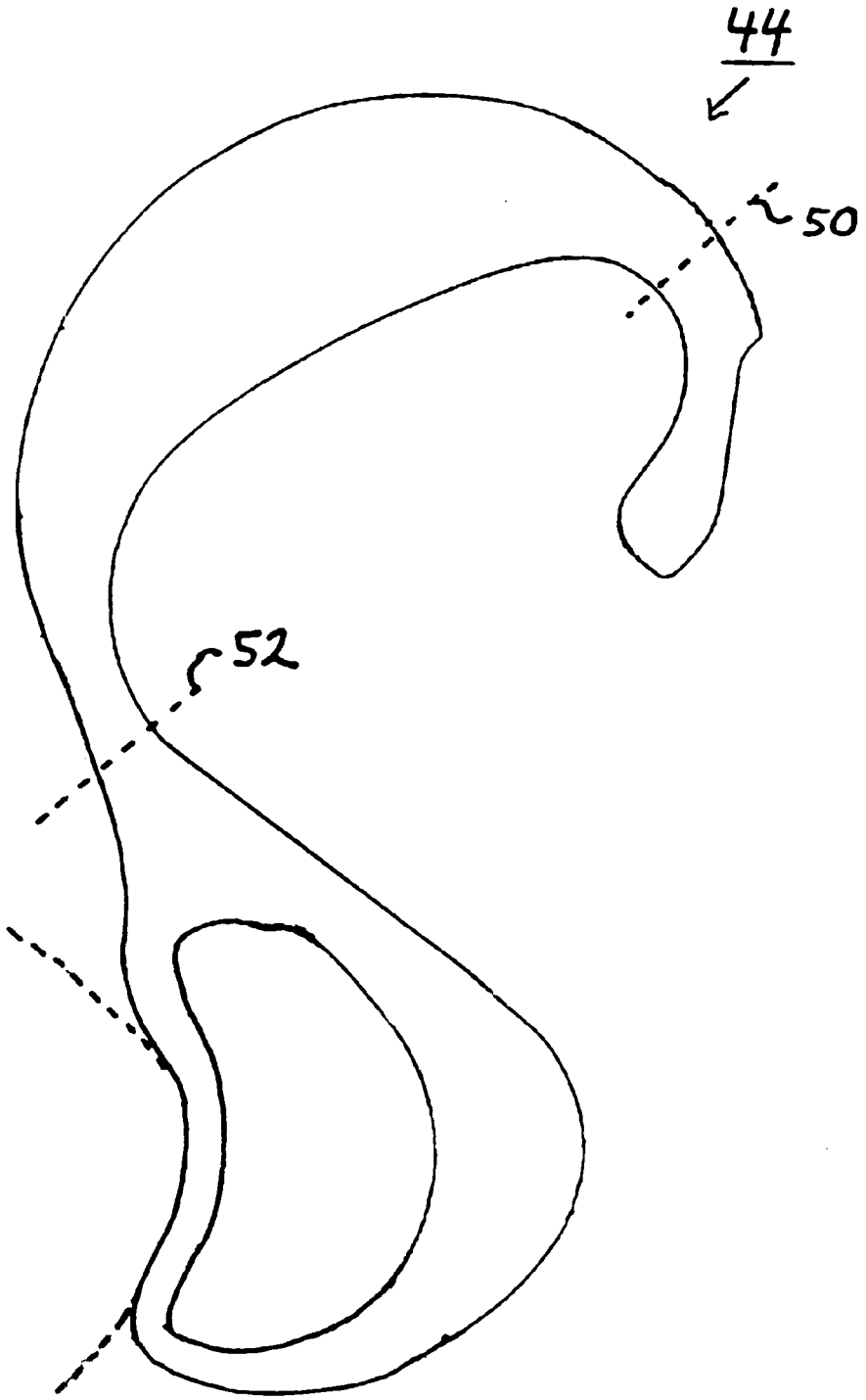
FIG. 2F is a plan view of a compressible member of an earhook according to an embodiment of the present invention.

The compressible member 44 may additionally form a digit receiving member 46, or loop, at one end. The use of a compressible material in forming the digit receiving member 46 is advantageous because it allows the member 46 to deform when pressed against an unyielding object. As a result, the digit receiving member 46 may have a relatively large diameter to fit a variety of finger or thumb sizes, but to also have a reduced diameter when the earhook 10 is worn. For example, as shown in FIG. 2F, the digit receiving member 46 may come in contact with a ridge or protuberance on a portion of the user's head behind and below the ear. Rather than creating a pinch point as with conventional earhooks, the compressible digit receiving member 46 is deformed to accommodate the irregularity.

Figure 2G:
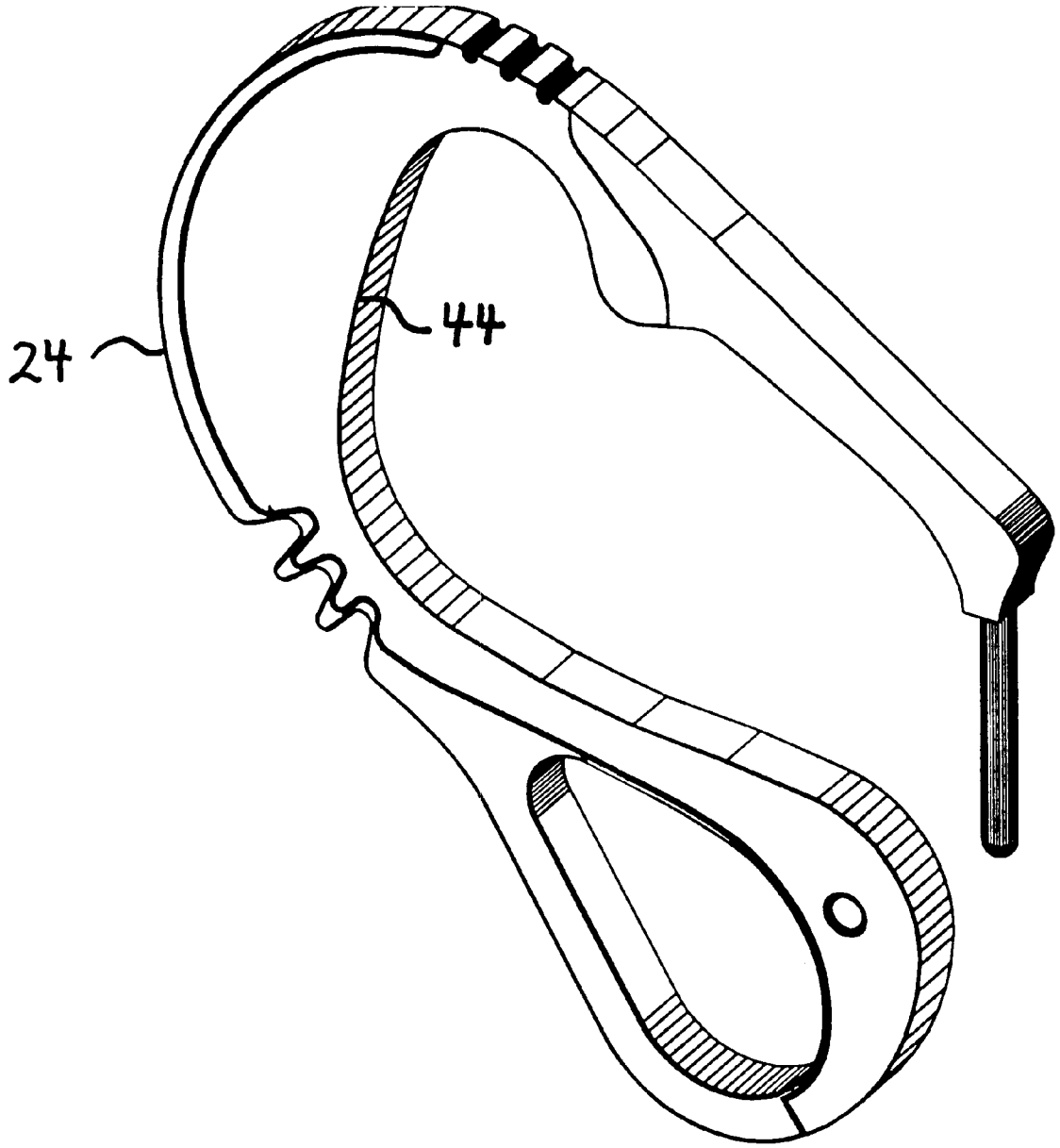
FIG. 2G is a perspective view of an earhook according to an embodiment of the present invention.

Referring again to FIG. 2A, there is shown an illustration of the complete assembly of the earhook 10. The compressible member 44 is coupled to the inner surface of the prehensile member 24, disposed between the prehensile member 24 the user's ear. The prehensile member 24 may be bonded to the compressible member 44 using an adhesive, heat, or by another conventional process. Additionally, as shown in FIG. 2D, the vanes 42 of the prehensile member 24 may be received by the reciprocal groves 48 in the compressible member 44 to provide additional stability. FIG. 2G is a perspective view of the complete assembly of the earhook 10, illustrating the combination of the prehensile member 24 and the compressible member 44.

In operation, the clamping pressure imposed by the prehensile member 24 causes the compressible member 44 to compress and expand to conform to the individual contours of the user's ear, snugly and securely grasping the ear to provide both stability and comfort. Thus, the earhook 10 may be comfortably and securely worn by a wide variety of users without fear of pinch points or other problems so prevalent with conventional earhooks.

Referring now to FIG. 3A, there is shown an illustration of the earhook 10 in combination with a conventional audio receiver/transmitter 22 assembly. Audio receiver/transmitters 22 are widely available in the art, such as the receiver/transmitter 22 used in the DuoSet™ Convertible Headset available from Plantronics, Inc. of Santa Cruz, Calif., although other receiver/transmitters could be used without departing from the spirit of the invention.

In one embodiment, the receiver/transmitter 22 includes a recess 54 for receiving the spindle 40 of the prehensile member 24 to form a simple, single-axis joint. In an alternative embodiment, a ball/ball tube assembly could be used to create a ball joint, as described in U.S. Pat. No. 5,761,298 to Davis et al. for "Communications Headset With Universally Adaptable Receiver and Voice Transmitter", which is incorporated herein by reference. The joint allows the allows the user to selectively position audio receiver/transmitter assembly 22 relative to the earhook 10 on one or more axes to secure a receiver element 56 over the user's ear and a transmitter element 60 (shown in FIG. 1C), typically a boom microphone or sound tube, near the user's mouth.

In an alternative embodiment, the prehensile member 24 may be coupled to a receiver element 56 without a transmitter element 60, for applications that do not require an audio transmitter 60. Alternatively, the prehensile member 24 may be coupled to a transmitter element 60 without the receiver 56.

Figure 3B:
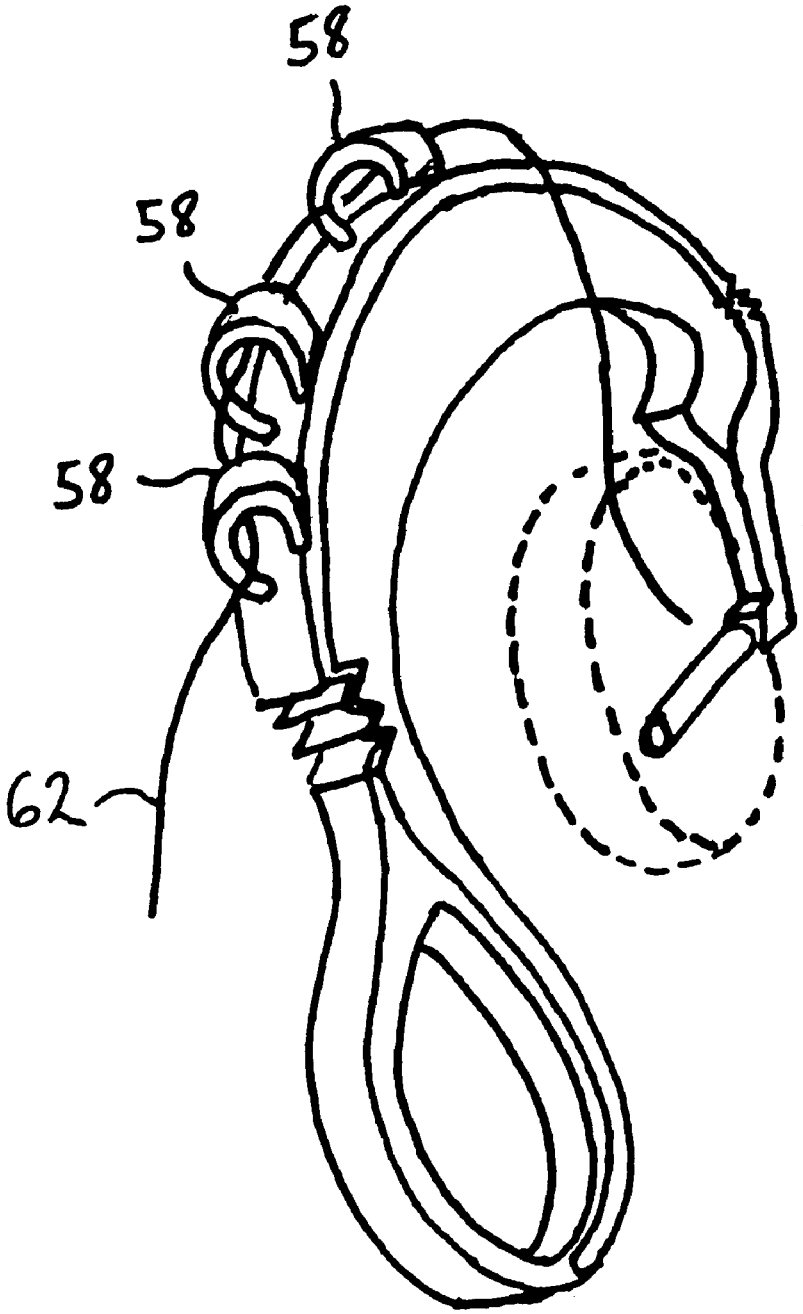
FIG. 3B is a perspective view of an earhook according to an embodiment of the present invention.

In one embodiment, one or more cord guides 58 are longitudinally disposed along the outer surface of the prehensile member 24, which are used to secure audio cords 62 (not shown) to the earhook 10 that run to and from the audio receiver/transmitter assembly 22. For example, as shown in FIG. 3B, the cord guides 58 may be implemented as hooks, although a variety of other mechanisms could be used within the scope of the invention. The cord guides 58 secure the audio cords to the prehensile member, keeping the cords conveniently behind the ear and away from the user's field of view. In alternative embodiments, the audio cords may pass directly through the prehensile or compressible members 24, 44 by means of a longitudinal bore (not shown).

Figure 4B:
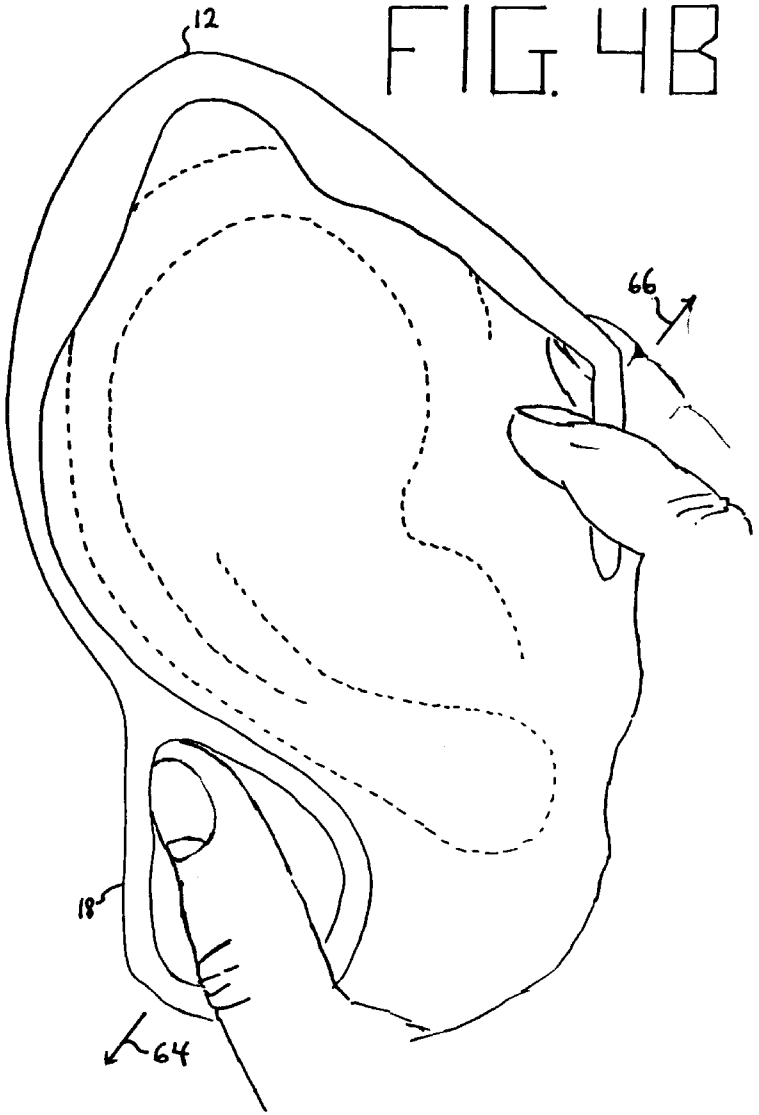
FIGS. 4A–C are illustrations of a method for donning an earhook according to an embodiment of the present invention.
Figure 4A:
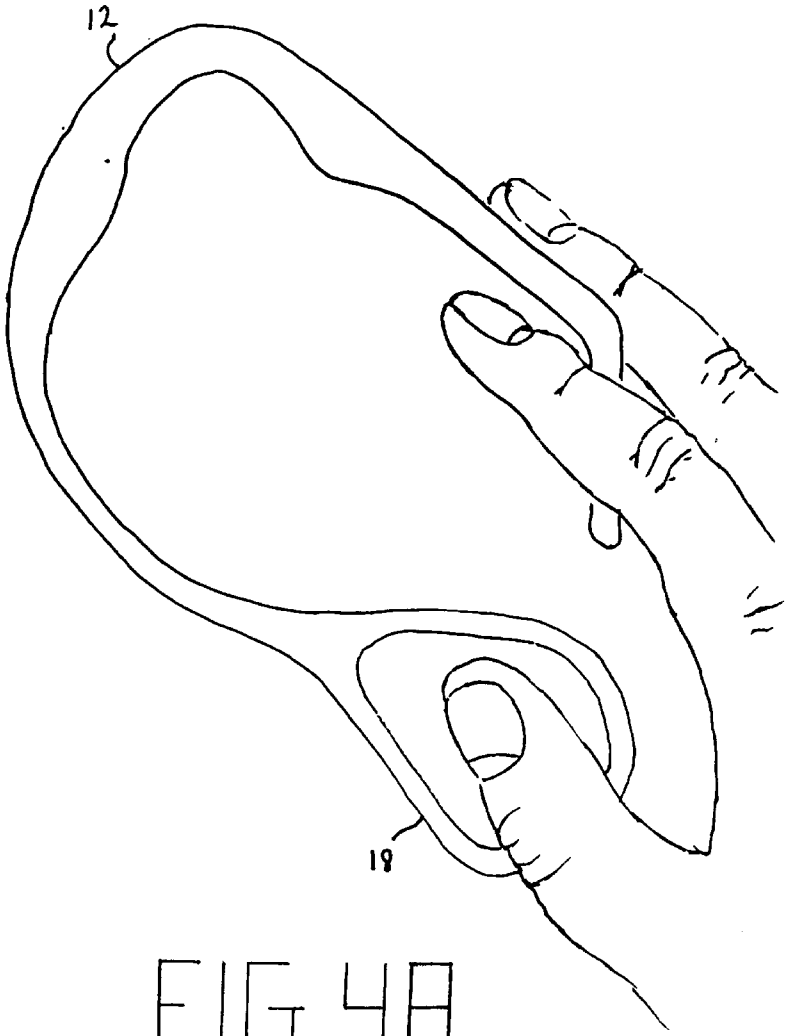
Figure 4E:
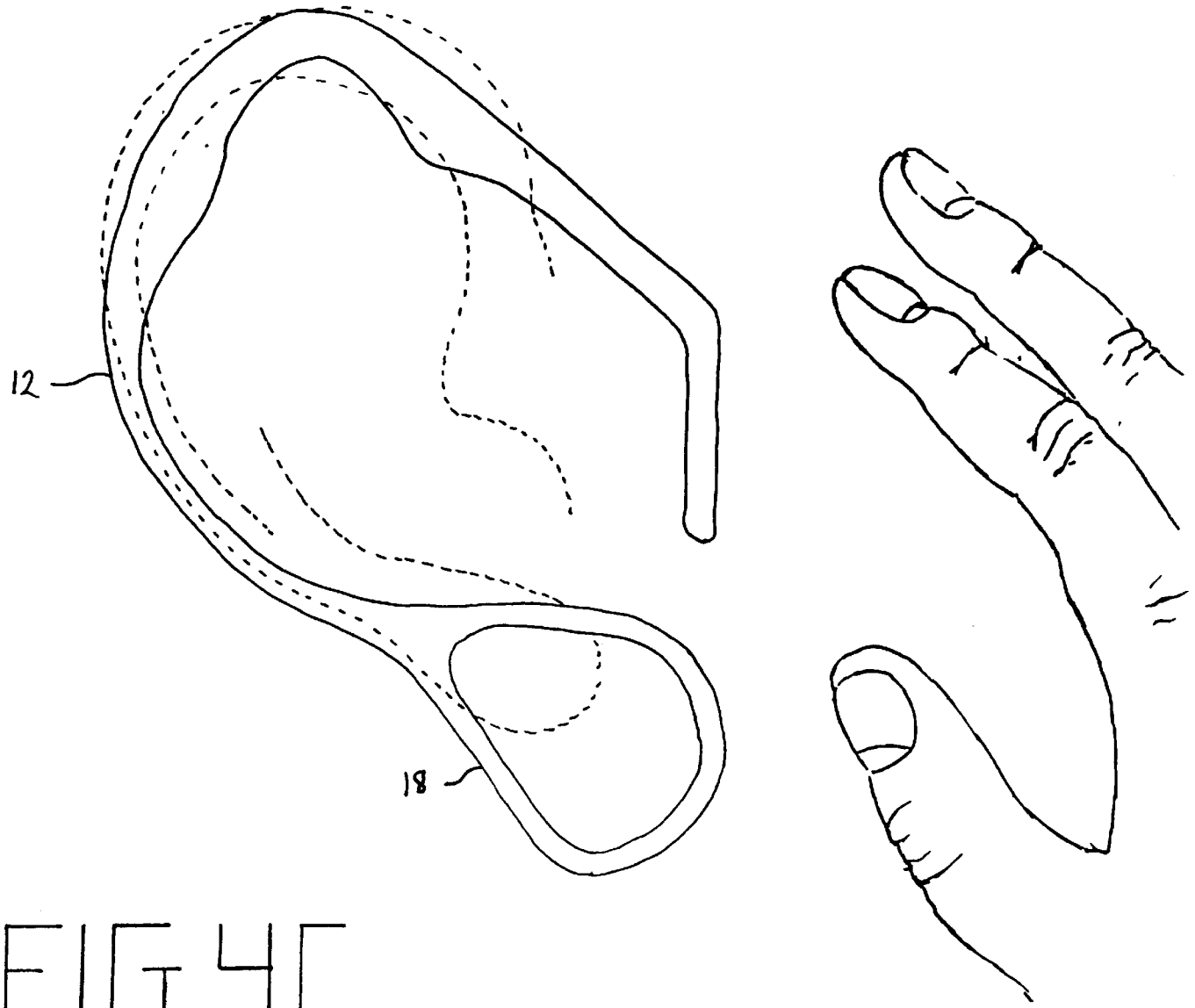

Referring now to FIGS. 4A–C, there is illustrated a method of donning an earhook 10 according to one embodiment of the invention. As noted previously, the novel design of the earhook 10 allows the user to easily don the earhook with only one hand, while conventional earhooks often require two-hand fitting and adjustment. For purposes clarity, the earhook 10 of FIG. 1A is illustrated. Nevertheless, the various embodiments illustrated in FIGS. 1D, 2A, and 2G, could also be used.

As shown in FIG. 4A, the earhook includes a prehensile member 12 having a curved portion adapted to curve at least partially around and behind the ear to securely grasp the ear between first and second ends of the curved portion. In one embodiment, the prehensile member 12 is resiliently biased to exert clamping pressure against the ear, and includes a digit receiving member 18 at the first end for removeably receiving a digit.

The method for donning the earhook 10 begins by grasping the second end of the prehensile member 12 between two digits. This may be done, for example, using the index and middle fingers, or the middle and ring fingers. In an alternative embodiment, the second end may be coupled to an audio receiver/transmitter assembly 22, as illustrated in FIGS. 1C and 3A. In such an embodiment, the user may grasp the audio receiver/transmitter assembly 22 rather than the second end of the prehensile member 12. For example, the user may grasp the boom or sound tube portion of the audio transmitter 60. In yet another alternative embodiment, the user could insert a digit, such as an index finger, into a digit receiving member 18B disposed near the second end, as illustrated in FIG. 1D.

The method continues by inserting a digit, typically a thumb, into the digit receiving member 18. Thereafter, as shown in FIG. 4B, the user exerts a force (indicated by arrow 64) on the digit receiving member 18 directed away from the second end to open the earhook 10 to a diameter larger than the diameter of the ear. It should be recognized that the user could additionally exert an opposing force on the second end of the prehensile member, as indicated by the arrow 66.

After the earhook 10 is open, the method continues by positioning the earhook 10 on the ear. The earhook 10 should be positioned such that it is comfortable on the ear, and that the audio receiver/transmitter assembly 22, if any, is properly aligned with the user's ear and mouth. In one embodiment, as shown in FIG. 2A, the earhook comprises first and second flex points 28A–B, and the positioning step includes positioning the second flex point 28B at about the apex of the ear, and the first flex point 28A at about an opposite side of the ear near the anti-apex.

Referring to FIG. 4C, after the earhook 10 is positioned, the method continues by removing the digit from the digit receiving member 18 to allow the earhook 10 to resiliently grasp the ear in response to the clamping pressure provided by the prehensile member 12. In the embodiment illustrated in FIG. 2A, the clamping pressure imposed by the prehensile member 24 causes the compressible member 44 to compress and expand to conform to the individual contours of the user's ear, snugly and securely grasping the ear to provide both stability and comfort.

A method for removing the earhook 10 is similar to the method for donning the earhook 10 described above. The method begins by inserting a digit into the digit receiving member 18. Thereafter, the method continues by exerting a first force on the digit receiving member 18 directed away from the ear and in opposition to the clamping pressure to open the earhook 10 to a diameter larger than a diameter of the ear. Finally, the method concludes by exerting a second force on the digit receiving member 18 substantially orthogonal to the first force to remove the earhook 10 from the plane of the ear.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the present invention.

What is claimed is:

1. In a communication headset having an earhook, the earhook comprising:

a prehensile portion having a curved portion adapted to curve at least partially around and behind an ear in substantially a first plane to securely grasp the ear between first and second ends of the curved portion; and a digit receiving member comprising a closed loop and coupled to the first end of the prehensile portion, the digit receiving member for removeably receiving a digit for opening the prehensile portion by exerting force upon the digit receiving member directed away from the second end, in order to place the prehensile portion around the ear.

2. The earhook of claim 1 further comprising:

a second digit receiving member coupled to the second end of the prehensile portion, the second digit receiving member for removeably receiving a digit for opening the prehensile portion by exerting force upon the second digit receiving member directed away from the first end.

3. The earhook of claim 1, wherein the digit receiving member is deformable.

4. The earhook of claim 1, wherein the prehensile portion is resiliently biased toward the ear in substantially the first plane to exert clamping pressure against the ear.

5. The earhook of claim 4, wherein the prehensile portion flexes within a second plane substantially perpendicular to the first plane, the prehensile portion resiliently biased to exert a force normal to and directed toward the first plane.

6. The earhook of claim 1, wherein the prehensile portion includes a compressible surface for contacting the ear, wherein the compressible surface is conformable to the ear in response to the clamping pressure and the shape of the ear.

7. The earhook of claim 6, wherein at least a portion of the compressible surface has a substantially greater radial thickness than a radial thickness of the prehensile portion.

8. The earhook of claim 7, wherein the compressible surface has a point of greatest radial thickness between the apex and anti-apex of the ear and is tapered toward the apex and anti-apex.

9. The earhook of claim 1, wherein the prehensile portion includes at least one substantially rigid portion and a first flexible portion, the first flexible portion resiliently biased toward the ear in the first plane to provide clamping pressure against the ear.

10. The earhook of claim 9, wherein the first flexible portion has a reduced cross-sectional area relative to the cross-sectional area of the rigid portion.

11. The earhook of claim 9, wherein the prehensile portion comprises a second flexible portion, the second flexible portion resiliently biased toward the ear in the first plane, the second flexible portion having a different degree of flexibility than the first flexible portion to provide progressive clamping pressure against the ear.

12. An earhook for a communication headset comprising:

a prehensile portion adapted to curve at least partially around and behind an ear in substantially a first plane, the prehensile portion resiliently biased toward the ear in the first plane to provide clamping pressure against the ear, and wherein the prehensile portion comprises at least one substantially rigid portion and a first flexible portion, the first flexible portion resiliently biased toward the ear in the first plane to provide clamping pressure, and wherein the first flexible portion is corrugated; and a compressible portion coupled to the prehensile portion and disposed between the prehensile portion and the ear, the compressible portion adapted to curve at least partially around and behind the ear in substantially the first plane to conform to the ear in response to the clamping pressure and the shape of the ear.

13. An earhook for a communication headset comprising:

a prehensile portion adapted to curve at least partially around and behind an ear in substantially a first plane, the prehensile portion resiliently biased toward the ear in the first plane to provide clamping pressure against the ear;

a compressible portion coupled to the prehensile portion and disposed between the prehensile portion and the ear, the compressible portion adapted to curve at least partially around and behind the ear in substantially the first plane to conform to the ear in response to the clamping pressure and the shape of the ear; and wherein the prehensile portion comprises at least one substantially rigid portion, a first flexible portion resiliently biased toward the ear in the first plane to provide clamping pressure, and a second flexible portion, the second flexible portion resiliently biased toward the ear in the first plane and having a different degree of flexibility than the first flexible portion, the first and second flexible portions together providing progressive clamping pressure against the ear.

14. The earhook of claim 13, wherein the second flexible portion is located at about the apex of the ear, and the first flexible portion is located at about the anti-apex of the ear.

15. An earhook for a communication headset comprising:

a prehensile portion adapted to curve at least partially around and behind an ear in substantially a first plane, the prehensile portion resiliently biased toward the ear in the first plane to provide clamping pressure against the ear;

a compressible portion coupled to the prehensile portion and disposed between the prehensile portion and the ear, the compressible portion adapted to curve at least partially around and behind the ear in substantially the first plane to conform to the ear in response to the clamping pressure and the shape of the ear; and a digit receiving member comprising a closed loop and coupled to a first end of the prehensile portion, the digit receiving member for removeably receiving a digit for opening the prehensile portion by exerting force upon the digit receiving member directed away from a second end of the prehensile portion, in order to place the earhook around the ear.

16. The earhook of claim 15 further comprising:

a second digit receiving member coupled to the second end of the prehensile portion, the second digit receiving member for removeably receiving a digit for opening the prehensile portion by exerting force upon the second digit receiving member directed away from the first end.

17. The earhook of claim 15, wherein the digit receiving member is a deformable.

18. An earhook for a communication headset comprising:

a substantially rigid outer member having a curved portion adapted to curve at least partially around and behind an ear in substantially a first plane to securely grasp the ear between first and second ends of the curved portion, the outer member comprising first and second flex points for resiliently biasing the outer member toward the ear and providing progressive clamping pressure against the ear; and a compressible inner member coupled to the outer member and disposed between the outer member and the ear, the inner member adapted to curve at least partially around and behind the ear in substantially the first plane to conform to the ear in response to the clamping pressure and the shape of the ear.

19. The earhook of claim 18, wherein the first flex point has a different degree flexibility than the second flex point.

20. The earhook of claim 18, wherein the second flex point is located at about the apex of the ear, and the first flex point is located at about an opposite side of the ear, when the earhook is worn.

21. The earhook of claim 18, further comprising:

a digit receiving member coupled to a first end of the outer member, the digit receiving member for removeably receiving a digit for opening the outer member by exerting force upon the digit receiving member directed away from a second end of the outer member.

22. The earhook of claim 21, further comprising:

a second digit receiving member coupled to the second end of the outer member, the second digit receiving member for removeably receiving a digit for opening the outer member by exerting force upon the second digit receiving member directed away from the first end of the outer member.

23. The earhook of claim 18, wherein at least a portion of the inner member has a substantially greater radial thickness than a radial thickness of the outer member.

24. The earhook of claim 12 or 13, wherein the prehensile portion flexes within a second plane substantially perpendicular to the first plane, the prehensile portion resiliently biased to exert a force normal to and directed toward the first plane.

25. The earhook of claim 12, 13 or 15, wherein at least a portion of the compressible portion has a substantially greater radial thickness than a radial thickness of the prehensile portion.

26. The earhook of claim 12, 13 or 15, wherein the compressible portion has a point of greatest radial thickness between the apex and anti-apex of the ear and is tapered toward the apex and anti-apex.

27. The earhook of claim 12 or 13, wherein the first flexible portion has a reduced cross-sectional area relative to the cross-sectional area of the rigid portion.

28. A communication headset comprising:

an earhook comprising:

a prehensile portion adapted to curve at least partially around and behind an ear in substantially a first plane, the prehensile portion resiliently biased toward the ear in the first plane to provide clamping pressure against the ear, and wherein the prehensile portion flexes within a second plane substantially perpendicular to the first plane, the prehensile portion resiliently biased to exert a force normal to and directed toward the first plane;

a compressible portion coupled to the prehensile portion and disposed between the prehensile portion and the ear, the compressible portion adapted to curve at least partially around and behind the ear in substantially the first plane to conform to the ear in response to the clamping pressure and the shape of the ear; and an audio receiver, coupled near an end of the earhook and disposed adjacent to the ear, for converting electrical signals into audible signals.

29. A communication headset comprising:

an earhook comprising:

a prehensile portion adapted to curve at least partially around and behind an ear in substantially a first plane, the prehensile portion resiliently biased toward the ear in the first plane to provide clamping pressure against the ear;

a compressible portion coupled to the prehensile portion and disposed between the prehensile portion and the ear, the compressible portion adapted to curve at least partially around and behind the ear in substantially the first plane to conform to the ear in response to the clamping pressure and the shape of the ear;

an audio receiver, coupled near an end of the earhook and disposed adjacent to the ear, for converting electrical signals into audible signals; and a digit receiving member coupled to a first end of the prehensile portion, the digit receiving member for removeably receiving a digit for opening the prehensile portion by exerting force upon the digit receiving member directed away from a second end of the prehensile portion.

30. The communication headset of 29 further comprising:

a second digit receiving member coupled to the second end of the prehensile portion, the second digit receiving member for removeably receiving a digit for opening the prehensile portion by exerting force upon the second digit receiving member directed away from the first end.

31. The communication headset of claim 28 or 29, further comprising:

an audio transmitter, coupled to the audio receiver, for converting audible signals into electrical signals.

32. A method of donning a communication headset comprising an earhook, the earhook having a curved portion adapted to curve at least partially around and behind an ear to securely grasp the ear between first and second ends of the curved portion, the earhook resiliently biased to exert clamping pressure against the ear, the earhook comprising a digit receiving member comprising a closed loop at the first end for removeably receiving a digit, the method comprising:

grasping the second end of the earhook with first and second digits;

inserting a third digit into the digit receiving member;

exerting a force on the digit receiving member directed away from the second end and in opposition to the clamping pressure to open the earhook to a diameter larger than a diameter of the ear;

positioning the earhook on the ear; and removing the third digit from the digit receiving member to allow the earhook to resiliently grasp the ear in response to the clamping pressure.

33. The method of claim 32, wherein the earhook comprises first and second flex points, and the positioning step comprises positioning the second flex point at about the apex of the ear, and the first flex point at about an opposite side of the ear.

34. The method of claim 32, wherein the grasping step comprises grasping the second end between an index finger and a middle finger.

35. The method of claim 32, wherein the grasping step comprises grasping the second end between a middle finger and a ring finger.

36. The method of claim 32, wherein the inserting step comprises inserting a thumb into the digit receiving member.

37. A method of donning a communication headset comprising an earhook and an audio transmitter coupled near a first end the earhook, the earhook having a curved portion adapted to curve at least partially around and behind an ear, the earhook resiliently biased to exert clamping pressure against the ear, the earhook comprising a digit receiving member comprising a closed loop coupled to a second end of the earhook for removeably receiving a digit, the method comprising:

grasping the audio transmitter with first and second digits;

inserting a third digit into the digit receiving member;

exerting a force on the digit receiving member directed away from the audio transmitter and in opposition to the clamping pressure to open the earhook to a diameter larger than a diameter of the ear;

positioning the earhook on the ear; and removing the third digit from the digit receiving member to allow the earhook to resiliently grasp the ear in response to the clamping pressure.

38. A method of removing a communication headset comprising an earhook, the earhook having a curved portion curving at least partially around and behind an ear in a substantially first plane, the earhook resiliently biased to exert clamping pressure against the ear, the earhook comprising a digit receiving member comprising a closed loop for removeably receiving a digit, the method comprising:

inserting a digit into the digit receiving member;

exerting a first force on the digit receiving member directed away from the ear and in opposition to the clamping pressure to open the earhook to a diameter larger than a diameter of the ear; and exerting a second force on the digit receiving member substantially normal to the first plane and directed outward from the ear to remove the earhook.

39. A method of donning a communication headset comprising an earhook, the earhook having a curved portion adapted to curve at least partially around and behind an ear to securely grasp the ear between first and second ends of the curved portion, the earhook resiliently biased to exert clamping pressure against the ear, the earhook comprising a first digit receiving members comprising a closed loop and a second digit receiving member, said first and second digit receiving members disposed at the first and second ends, respectively, the first and second digit receiving members for removeably receiving a digit, the method comprising:

inserting a first digit into the first digit receiving member;

inserting a second digit into the second digit receiving member;

exerting oppositely-directed forces on the first and second digit receiving members in opposition to the clamping pressure to open the earhook to a diameter larger than a diameter of the ear;

positioning the earhook on the ear; and removing the first and second digits from the first and second digit receiving members to allow the earhook to resiliently grasp the ear in response to the clamping pressure.

40. In a communication headset having an earhook, the earhook comprising:

a prehensile portion having a curved portion adapted to curve at least partially around and behind an ear in substantially a first plane to securely grasp the ear between first and second ends of the curved portion; and a digit receiving member comprising a partially-closed loop that does not grip an earlobe and coupled to the first end of the prehensile portion, the digit receiving member for removeably receiving a digit for opening the prehensile portion by exerting force upon the digit receiving member directed away from the second end, in order to place the prehensile portion around the ear.

41. An earhook for a communication headset comprising:

a prehensile portion adapted to curve at least partially around and behind an ear in substantially a first plane, the prehensile portion resiliently biased toward the ear in the first plane to provide clamping pressure against the ear;

a compressible portion coupled to the prehensile portion and disposed between the prehensile portion and the ear, the compressible portion adapted to curve at least partially around and behind the ear in substantially the first plane to conform to the ear in response to the clamping pressure and the shape of the ear; and a digit receiving member comprising a partially-closed loop that does not grip an earlobe and coupled to a first end of the prehensile portion, the digit receiving member for removeably receiving a digit for opening the prehensile portion by exerting force upon the digit receiving member directed away from a second end of the prehensile portion, in order to place the earhook around the ear.

42. A method of donning a communication headset comprising an earhook, the earhook having a curved portion adapted to curve at least partially around and behind an ear to securely grasp the ear between first and second ends of the curved portion, the earhook resiliently biased to exert clamping pressure against the ear, the earhook comprising a digit receiving member comprising a partially-closed loop that does not grip an earlobe and coupled to the first end for removeably receiving a digit, the method comprising:

grasping the second end of the earhook with first and second digits;

inserting a third digit into the digit receiving member;

exerting a force on the digit receiving member directed away from the second end and in opposition to the clamping pressure to open the earhook to a diameter larger than a diameter of the ear;

positioning the earhook on the ear; and removing the third digit from the digit receiving member to allow the earhook to resiliently grasp the ear in response to the clamping pressure.

43. A method of donning a communication headset comprising an earhook and an audio transmitter coupled near a first end the earhook, the earhook having a curved portion adapted to curve at least partially around and behind an ear, the earhook resiliently biased to exert clamping pressure against the ear, the earhook comprising a digit receiving member comprising a partially-closed loop that does not grip an earlobe and coupled to a second end of the earhook for removeably receiving a digit, the method comprising:

grasping the audio transmitter with first and second digits;

inserting a third digit into the digit receiving member;

exerting a force on the digit receiving member directed away from the audio transmitter and in opposition to the clamping pressure to open the earhook to a diameter larger than a diameter of the ear;

positioning the earhook on the ear; and removing the third digit from the digit receiving member to allow the earhook to resiliently grasp the ear in response to the clamping pressure.

44. A method of removing a communication headset comprising an earhook, the earhook having a curved portion curving at least partially around and behind an ear in a substantially first plane, the earhook resiliently biased to exert clamping pressure against the ear, the earhook comprising a digit receiving member comprising a partially-closed loop that does not grip an earlobe, said digit receiving member for removeably receiving a digit, the method comprising:

inserting a digit into the digit receiving member;

exerting a first force on the digit receiving member directed away from the ear and in opposition to the clamping pressure to open the earhook to a diameter larger than a diameter of the ear; and exerting a second force on the digit receiving member substantially normal to the first plane and directed outward from the ear to remove the earhook.

45. A method of donning a communication headset comprising an earhook, the earhook having a curved portion adapted to curve at least partially around and behind an ear to securely grasp the ear between first and second ends of the curved portion, the earhook resiliently biased to exert clamping pressure against the ear, the earhook comprising a first digit receiving members comprising a partially-closed loop that does not grip an earlobe and a second digit receiving member, said first and second digit receiving members disposed at the first and second ends, respectively, the first and second digit receiving members for removeably receiving a digit, the method comprising:

inserting a first digit into the first digit receiving member;

inserting a second digit into the second digit receiving member;

exerting oppositely-directed forces on the first and second digit receiving members in opposition to the clamping pressure to open the earhook to a diameter larger than a diameter of the ear;

positioning the earhook on the ear; and removing the first and second digits from the first and second digit receiving members to allow the earhook to resiliently grasp the ear in response to the clamping pressure.

* * * * *

UNITED STATES PATENT AND TRADEMARK OFFICE

CERTIFICATE OF CORRECTION

PATENT NO. : 6,449,374 B1 
DATED : September 10, 2002
INVENTOR(S) : Gerald W. Skulley and Thomas G. Skulley It is certified that error appears in the above-identified patent and that said Letters Patent is hereby corrected as shown below:

Title page,
Item [74], *Attorney, Agent, or Firm*, reading "Peter Hsien" should read -- Peter Hsieh --.

Signed and Sealed this

Twenty-eighth Day of January, 2003

JAMES E. ROGAN
*Director of the United States Patent and Trademark Office*